US010603674B2

(12) United States Patent
Salonen

(10) Patent No.: US 10,603,674 B2
(45) Date of Patent: Mar. 31, 2020

(54) IMPACT CRUSHER ROTOR POSITION DETECTION AND CONTROL

(75) Inventor: Marko Salonen, Tampere (FI)

(73) Assignee: METSO MINERALS, INC., Helsinki (FI)

( * ) Notice: Subject to any disclaimer, the term of this patent is extended or adjusted under 35 U.S.C. 154(b) by 1357 days.

(21) Appl. No.: 14/579,331

(22) PCT Filed: Jun. 29, 2012

(86) PCT No.: PCT/FI2012/050685
§ 371 (c)(1),
(2), (4) Date: Dec. 22, 2014

(87) PCT Pub. No.: WO2014/001606
PCT Pub. Date: Jan. 3, 2014

(65) Prior Publication Data
US 2015/0209797 A1 Jul. 30, 2015

(51) Int. Cl.
*B02C 25/00* (2006.01)
*B02C 13/26* (2006.01)
*B02C 13/09* (2006.01)

(52) U.S. Cl.
CPC ..... *B02C 25/00* (2013.01); *B02C 13/09* (2013.01); *B02C 13/095* (2013.01); *B02C 13/26* (2013.01)

(58) Field of Classification Search
CPC ..... B02C 25/00; B02C 13/09; B02C 13/095; B02C 13/26
USPC ..... 241/27, 236
See application file for complete search history.

(56) References Cited

U.S. PATENT DOCUMENTS 3,768,743 A 10/1973 Smits
4,704,906 A * 11/1987 Churchill ..... G01S 15/88 340/683
5,325,027 A * 6/1994 Miettunen ..... B02C 17/1805 318/482
5,510,781 A * 4/1996 de Buda ..... G01B 17/06 250/231.13
6,953,168 B2 10/2005 Delille
(Continued)

FOREIGN PATENT DOCUMENTS

DE 10 2004 005 378 A1 8/2005
JP 2002 346410 A 12/2002

OTHER PUBLICATIONS

Angular—Google Definition Mar. 28, 2019 (Year: 2019).*
(Continued)

*Primary Examiner* — Faye Francis
(74) *Attorney, Agent, or Firm* — Andrus Intellectual Property Law, LLP

(57) ABSTRACT

An apparatus including a rotor position detection unit with a sensor configured to detect an angular position of a rotor of a horizontal shaft impact crusher, the rotor having attached thereon a group of hammers. A motor control system is configured to change the rotation speed of the rotor and an automation and control system is configured to control the motor control system in response to the detected angular position of the rotor. The rotor position detection unit is configured to detect a first and second angular position of the rotor corresponding to a first and second position of a hammer of the group of hammers attached to the rotor. The motor control system comprises a frequency converter and a brake configured to enable the stopping of the rotor.

15 Claims, 5 Drawing Sheets

(56) References Cited

U.S. PATENT DOCUMENTS

| | | | | |
|---|---|---|---|---|
| 7,293,725 | B2 * | 11/2007 | Moriya | B02C 13/095<br>241/189.1 |
| 2012/0073117 | A1 * | 3/2012 | Benedict | H02K 7/1838<br>29/596 |
| 2014/0117127 | A1 * | 5/2014 | Belotserkovskiy | B02C 2/042<br>241/24.25 |

OTHER PUBLICATIONS

Disc—Google Definition Mar. 15, 2019 (Year: 2019).*
English abstract of JP2002346410.
PCT International Search Report dated Apr. 17, 2013.
PCT Written Opinion dated Apr. 17, 2013.

* cited by examiner

IMPACT CRUSHER ROTOR POSITION DETECTION AND CONTROL

TECHNICAL FIELD

The invention relates to impact crusher rotor position detection and control.

BACKGROUND ART

Horizontal shaft impact (HSI) crushers are used in processing of mineral materials such as stone. In such a crusher the mineral material is thrown by a rotating rotor having a group of hammers or blow bars against a group of breaker plates having a wear element thereon.

The hammers need to be changed periodically due to wear. Furthermore, the position of the breaker plates needs to be calibrated by determining the distance of the wear parts of the breaker plates from the hammers. For these operations the rotor has been traditionally manually rotated to correct positions.

As an alternative to manually rotating the rotor, a separate motor for positioning has been previously used.

DE 10 2004 005 378 A1 shows a crusher contact calibration method wherein the contact calibration position is established by rotating the rotor backwards until contact occurs. This requires a certain form of the hammers and/or breaker plates.

SUMMARY

According to a first example aspect of the invention there is provided an apparatus comprising a rotor position detection unit configured to detect an angular position of a rotor of a horizontal shaft impact crusher, the rotor having attached thereon a group of hammers, the rotor position detection unit comprising a sensor;

a motor control system configured to change the rotation speed of the rotor; and an automation and control system configured to control the motor control system in response to the detected angular position of the rotor; wherein the rotor position detection unit is configured to detect a first angular position of the rotor corresponding to a first position of a hammer of the group of hammers attached to the rotor; and the motor control system comprises a frequency converter and a brake configured to enable the stopping of the rotor.

The rotor position detection unit may comprise a distance sensor and a counterpart element.

The sensor may be an ultrasound distance sensor and the counterpart element may be a disc with a varying diameter.

The rotor position detection unit may comprise an angular sensor.

The rotor position detection unit may comprise an optical sensor.

The rotor position detection unit may comprise a magnetic sensor.

The rotor position detection unit may be configured to detect a second angular position of the rotor corresponding to a second position of the hammer of the group of hammers attached to the rotor.

The group of hammers may comprise one or more hammers.

The rotor position detection unit may be configured to detect the angular positions of the rotor corresponding to a first and second position of each hammer of the group of hammers attached to the rotor.

The first position of each hammer of the group of hammers may be a service position of the hammer.

The second position of each hammer of the group of hammers may be a contact calibration position of the hammer.

The motor control system may be configured to stop the rotor at the first or second position of a hammer of the group of hammers using the frequency converter and the brake in response to detecting the first or second position of the hammer of the group of hammers.

The sensor may be configured to output a standard signal.

The standard signal may have a range of 4 to 20 mA.

The automation and control system may further be configured to measure the load of the crusher.

The automation and control system may further be configured to combine the measured load and the detected angular position of the rotor in order to monitor the crusher.

According to a second example aspect of the invention there is provided a horizontal shaft impact crusher for processing mineral material comprising a body;

an electric motor for rotating a rotor, the rotor having attached thereon a group of hammers;

at least one breaker plate having attached thereon a wear part;

means for moving the breaker plate and the wear part attached thereon with relation to the body and the rotor;

means for detecting contact between the breaker plate and a hammer, wherein the horizontal shaft impact crusher comprises an apparatus according to the first example aspect of the invention.

The horizontal shaft impact crusher may further comprise means for preventing the rotation of the rotor.

The horizontal shaft impact (HSI) crusher may further comprise means for preventing the rotation of the rotor.

According to a third example aspect of the invention there is provided a mineral material processing plant comprising a horizontal shaft impact crusher of the second example aspect of the invention.

The mineral material processing plant may be a mobile processing plant.

According to a fourth example aspect of the invention there is provided a method comprising causing rotating a rotor of a horizontal shaft impact crusher by an electric motor, the rotor having attached thereon a group of hammers;

detecting a first angular position of the rotor corresponding to a first position of a hammer of the group of hammers attached to the rotor with a rotor position detecting unit configured to detect an angular position of the rotor, the rotor position detection unit comprising a sensor; and causing controlling of the electric motor with a frequency converter and a brake configured to enable the stopping of the rotor.

The angular position of the rotor may be detected using a distance sensor and a counterpart element.

The angular position of the rotor may be detected using an ultrasound distance sensor and a counterpart disc with a varying diameter.

The angular position of the rotor may be detected with an angular sensor.

The angular position of the rotor may be detected with an optical sensor.

The angular position of the rotor may be detected with a magnetic sensor.

The method may further comprise detecting a second angular position of the rotor corresponding to a second position of the hammer of the group of hammers attached to the rotor.

The group of hammers may comprise one or more hammers.

The method may further comprise detecting the angular positions of the rotor corresponding to a first and second position of each hammer of the group of hammers attached to the rotor.

The first position of each hammer of the group of hammers may be a service position of the hammer.

The second position of each hammer of the group of hammers may be a contact calibration position of the hammer.

Controlling the rotation speed of the rotor may comprise setting the rotation speed of the rotor to a predetermined speed The method may further comprise stopping the rotor at the first or second position of a hammer of the group of hammers with a frequency converter and a brake in response of detecting the first or second position of the hammer of the group of hammers.

The sensor may output a standard signal.

The standard signal may have a range of 4 to 20 mA.

The method may further comprise measuring the load of the crusher.

The method may further comprise combining the measured load and the detected angular position of the rotor.

According to a fifth example aspect of the invention there is provided a computer program, comprising:

code for performing the method of an example aspect of the invention, when the computer program is run on a processor.

According to a sixth example aspect of the invention, there is provided a memory medium comprising the computer program of the fifth example aspect of the invention.

It has been found that the positioning of the rotor for both maintenance and calibration can be carried out in a cost-effective and safe way by using impact crusher position detection and control according to the example aspects of the invention.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying drawings, in which.

DETAILED DESCRIPTION

In the following description, like numbers denote like elements. It should be appreciated that the illustrated figures are not entirely in scale, and that the figures mainly serve the purpose of illustrating embodiments of the invention.

Figure 1:
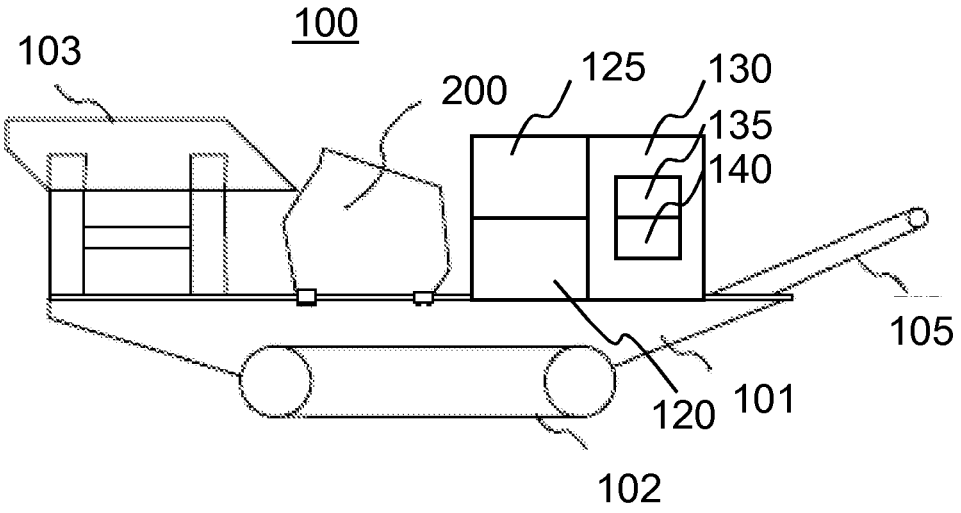
FIG. 1 shows a mineral material processing plant according to an example embodiment.

FIG. 1 shows a mineral material processing plant 100 according to an example embodiment. The mineral material processing plant 100 comprises a body 101 and traction elements 102 connected on both sides of the body 101 for moving the mobile crushing station 700. Fixed to the body 101 there are also an input feeder 103, a horizontal shaft impactor (HSI) crusher unit 200, and an output conveyor 105 for removing crushed material. Also carried by the body 101 there is a crusher motor unit 120 configured to provide operating power the crusher 200. In an example embodiment the crusher motor unit comprises an electric motor, such as for example a squirrel-cage rotor three-phase motor.

The mineral material processing plant further comprises a motor control system 130 and an automation and control system 125 communicatively connected to each other and to the motor 120. The motor control system 130 further comprises a frequency converter (FCC) 135 and a brake such as a DC injection brake 140 for changing the rotating speed of the motor 120 and for braking the motor 120 in order to enable stopping of the rotor 13 at a desired angular position. The motor control system 130 and the automation and control system 125, or parts thereof, can be provided as separate systems communicating with each other or be integrated into a single system. Furthermore, in an example embodiment, the frequency converter 135 and/or the brake 140 can be provided as separate units. A skilled person appreciates that in a further example embodiment the motor control system 130 and/or the automation and control system 125 can alternatively be provided as separate units instead of being carried by the body 101.

It should be noted that FIG. 1 shows a mobile mineral material processing plant 100 according to an example embodiment. In a further example embodiment, the mineral material processing plant 100 is a fixed plant. The skilled person appreciates that the mineral material processing plant can, in a further example embodiment, be a stationary mineral material processing plant comprising crushing, screening and conveying units or it can be a mobile or a haulable processing plant with crawler tracks, wheels, legs, skids or other suitable support means. Furthermore, the mineral material processing plant may comprise other parts or units not shown in FIG. 1 or some parts shown in FIG. 1 may not be present.

Figure 2:
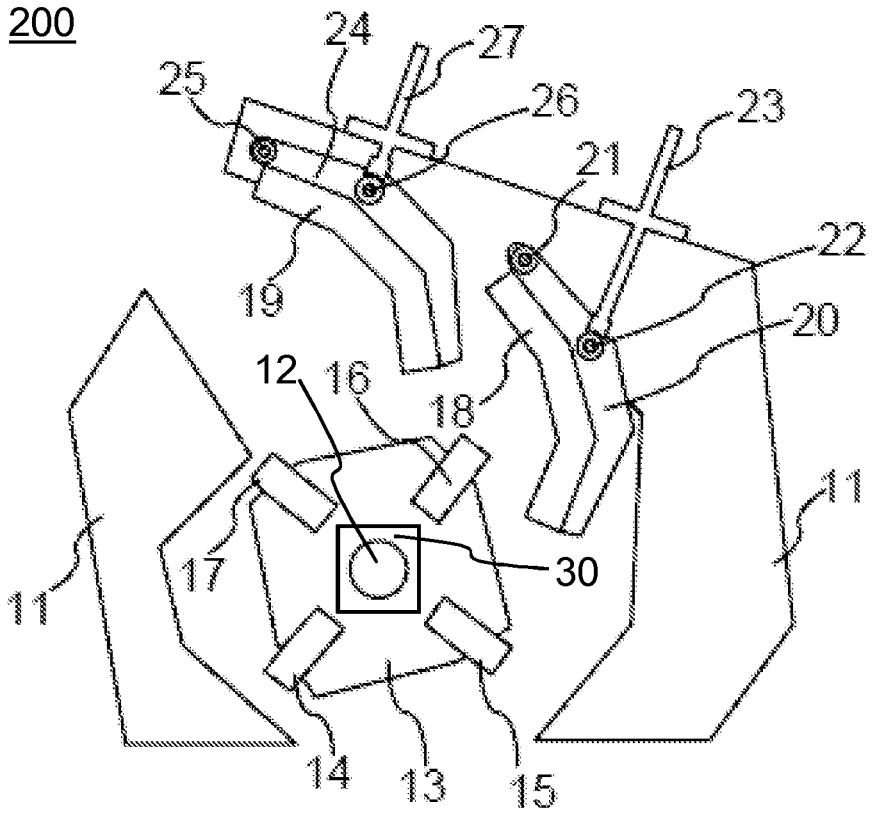
FIG. 2 shows a schematic representation of a horizontal shaft impactor crusher according to an example embodiment.

FIG. 2 shows a schematic representation of an HSI crusher 200 according to an example embodiment. The HSI crusher 200 comprises a body 11, a rotor axle shaft 12, a rotor 13, a group of impact hammers or blow bars 14, 15, 16, 17, herein after referred to as hammers, attachable and shown as being attached, to the rotor 13. The HSI crusher 200 further comprises wear parts 18, 19, breaker plates 20, 24, first joints 21, 25 for joining the breaker plates 20, 24 to the body and adjustment means 23, 27 for adjusting the position of the breaker plates with relation to the body and with relation to the rotor 13 and the hammers 14, 15, 16, 17 attached to the rotor 13. The HSI crusher 200 further comprises second joints 22, 26 for joining the adjustment means to the breaker plates. In operation, the rotor rotates about its axle shaft 12. The hammers 14, 15, 16, 17 hit and break pieces of mineral material, such as stones, when the rotor is rotating. Wear parts 18, 19 are attached resiliently to receive stones thrown by the hammers 14, 15, 16, 17. The resilient attaching or cushioning of the wear parts is implemented e.g. by resilient support structures behind the wear parts and/or by resilient adjustment means 23, 27 and/or resilient attachment of the adjustment means 23, 27 to the body 11. In an example embodiment, when a stone hits the wear part 18, 19, a resilient part in the adjustment means 23, 27 such as helical or torsion springs let the adjustment means yield under impact. The wear part hit by the stone with its supporting structure, i.e. breaker plate 20, 24 turns slightly about the first joint 21, 25 farther away from the rotor 13 and then resumes its original position again if not held back by other stones hitting the wear part 18, 19. Furthermore, the HSI crusher comprises a rotor position detection unit 30 configured to detect an angular position, hereinafter referred to as position, of the rotor 13. It should be noted that some angular positions of the rotor correspond to predetermined positions of the hammers 14, 15, 16, 17 of the group of hammers attached to the rotor. In an example embodiment the predetermined positions are a service position, or a first position, and a contact calibration position, or a second position. According to an example embodiment, the rotor position detection unit 30 is positioned at or adjacent to the rotor axle shaft 12 outside the crushing chamber of the HSI crusher 200. The rotor position detection unit 30 is communicatively connected to the automation and control system 125 and/or the motor control system 130. In a further example embodiment, the HSI crusher further comprises conventional locking means (not shown) which can be used to manually or automatically lock the rotor in place.

The wear parts 18, 19 and the hammers 14, 15, 16, 17 are susceptible to wear during operation of the HSI crusher 200. Accordingly, their position, and consequently the position of the breaker plates 20, 24, in relation to the hammers 14, 15, 16, 17 needs to be adjusted or calibrated and the amount of wear of the wear parts 18, 19 and/or the hammers 14, 15, 16, 17 needs to be detected or measured. For detection of the wear and for position adjustment, the rotor 13 needs to be in a certain position, i.e. one of the hammers 14, 15, 16, 17 needs to point substantially perpendicularly towards the wear part 18, 19. The detection of the wear and the subsequent adjustment of the position of the breaker plates 20, 24, hereinafter referred to as contact calibration, is carried out by moving a breaker plate 20, 24 closer to a hammer 14, 15, 16, 17 positioned at the proper position until contact occurs. The contact is detected with conventional measurement means, e.g. with a pressure switch. The distance at which contact occurred, indicating the amount of wear of the wear part 18, 19 or the hammer 14, 15, 16, 17, is then stored in the automation and control unit 125 for further use. This position of the hammer 14, 15, 16, 17 for contact calibration is detected by rotor position detection unit 30. Furthermore, the hammers 14, 15, 16, 17 need to be replaced with new hammers periodically due to wear. The replacement of the hammers 14, 15, 16, 17 is possible in a service position of the rotor in which position one of the hammers 14, 15, 16, 17 at a time is available for replacement. The service position is detected by the rotor position detection unit 30.

Figure 3:
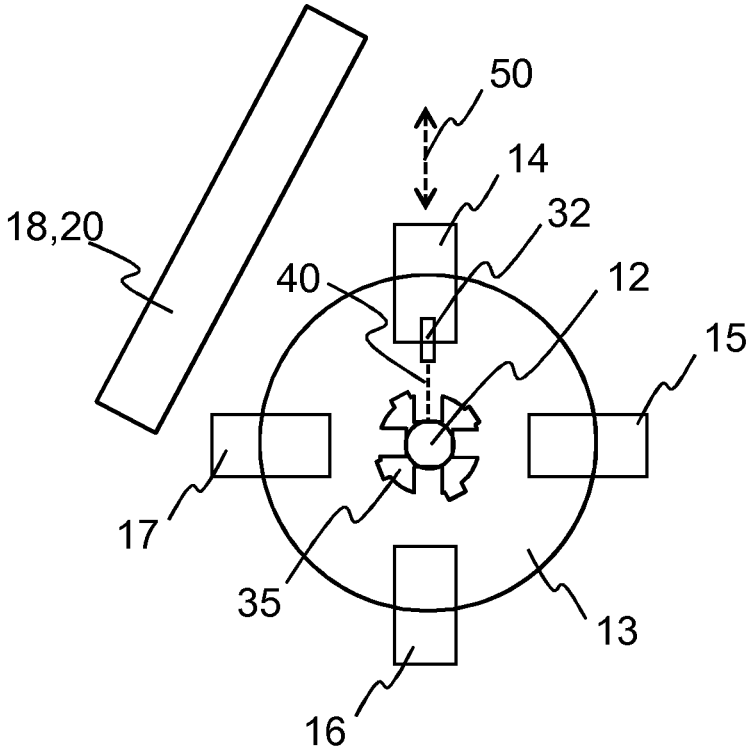
FIG. 3 shows a schematic representation of the principle of a first operation of a rotor position detection and control according to an example embodiment.
Figure 4:
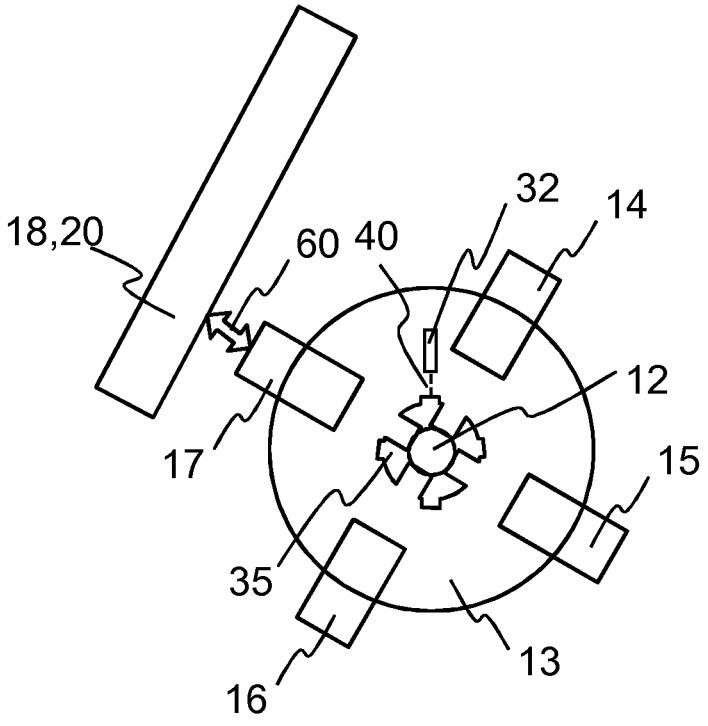
FIG. 4 shows a schematic representation of the principle of a second operation of a rotor position detection and control according to an example embodiment.

FIGS. 3 and 4 show a schematic representation of the principle of the operation of a rotor position detection and control according to an example embodiment. The rotor 13, the rotor axle shaft 12, the hammers 14, 15, 16, 17 and the breaker plate with the wear part 18, 20 are schematically depicted. Furthermore, a distance sensor 32, sensor in short, and a counterpart element 35 of the sensor 32 are shown. In FIG. 3 the rotor is in service position 50 with the hammer 14 positioned for service and/or replacement. Further hammers 15, 16, 17 can be positioned at the service position 50 in an analogous manner. In FIG. 4 the rotor is in contact calibration position 60 with the hammer 17 pointing substantially perpendicularly towards the combination of wear part and breaker plate 18, 20. Further hammers 14, 15, 16 can be positioned at the contact calibration position 60 in an analogous manner.

The sensor 32 is, according to an example embodiment, an ultrasound distance sensor. The sensor output is a standard signal, e.g. 4 to 20 mA, which is readily interfacable with conventional automation and control systems. The counterpart element 35, according to an example embodiment, is a disc of conventional material being formed in such a way as to have a varying diameter, i.e. the edge of the disc 35 has protrusions or is formed in such way as to be situated at different distance from the axle shaft 12 at different locations and accordingly at a different distance from the sensor 32. The distance between the sensor 32 and the edge of the disc 35 is detected by the sensor and converted to a sensor output. Each distance corresponds to a certain level of the standard signal and to a certain position of the rotor. In an example embodiment, as shown in FIGS. 3 and 4, the disc 35 has 12 different diameters, the distance of which corresponds to a contact calibration position and service position for each hammer 14, 15, 16, 17, and to four intermediate positions. In a further example embodiment, the disc 35 may have a different number of protrusions at different distances from the sensor. For example only two distances can be used, corresponding to the service position 50 and the contact calibration position. In such a case, the hammer which was positioned at the service position 50 or at the contact calibration position 60 at any given time would be calculated from the rotation angle of the axle with respect to the previous hammer that was at said position. In a further example embodiment, there are more than 12 different diameters of the disc, and in such a case the rotation angle, or position, of the rotor can be detected more accurately in conventional manner. FIGS. 3 and 4 show the service position 50 and the contact calibration position with respect to one wear part and breaker plate 18, 20. The skilled person appreciates that similar positions for further wear parts and breaker plates can be detected in an analogous manner, for example using a counterpart disc 35 with more separate diameters and accordingly distances from the sensor 35 or by using several counterpart discs 35, i.e. one disc 35 for each combination of wear part and breaker plate.

In a further example embodiment, the sensor 32 and/or the counterpart element 35 are of a different type or have a different structure. For example an encoder disc having thereon a binary code with a desired number of bits for indicating the service and contact calibration positions and one or more optical sensors for reading the encoder disc can be used. In a further example embodiment, a number of optical transmitter receiver pairs can be used. In a still further example embodiment a magnetic distance sensor can be used with a suitable counterpart disc and/or elements. The skilled person appreciates that any conventional analog or digital angular and/or distance sensor with or without a corresponding counterpart disc or the like can be used. In a further example embodiment more than one sensor and/or counterpart element of different or same type are used.

Figure 5:
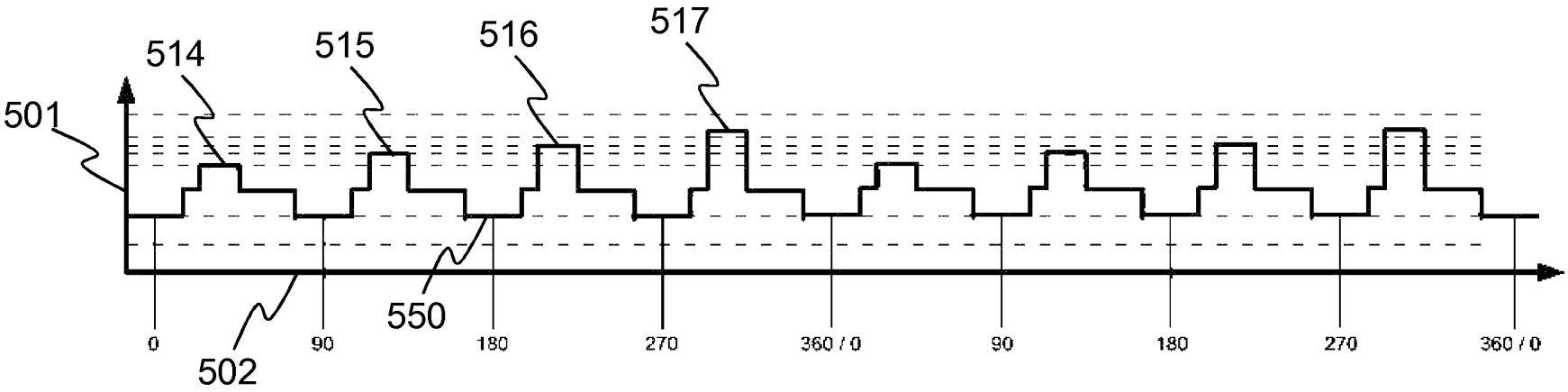
FIG. 5 shows an output of a sensor of a rotor position detection unit according to an example embodiment.

FIG. 5 shows an output of the sensor 32 of a rotor position detection unit 30 according to an example embodiment. Horizontal axis of the depicted graph shows the angle of rotation of the rotor 13 and the vertical axis shows the level of the output of the sensor 32, e.g. the level of a standard signal from 4 to 20 mA. The graph shows the sensor output as the rotor 13 is rotated. The output level 514, 515, 516, 517 for each hammer 14, 15, 16, 17 is different in the contact calibration position 60, and each service position 50 has a similar output level 550. The output levels corresponding to intermediate positions are also shown. In a further example embodiment, the service position 50 of each hammer 14, 15, 16, 17 has a different output level.

In a further example embodiment, the rotor position measurement from the rotor position detection unit 30 is used for providing further information into the automation and control system 125 and therethrough to the user of the HSI crusher 200. For example, the rotor position information can be used to provide graphs of crusher load, which is measured in conventional manner, with respect to each hammer 14, 15, 16, 17 position. Accordingly, the load used on each combination of wear part and breaker plate 18, 20 can be measured and visualized and used e.g. to distribute the load evenly or in any other desired manner for greater processing capacity and energy saving.

Figure 6:
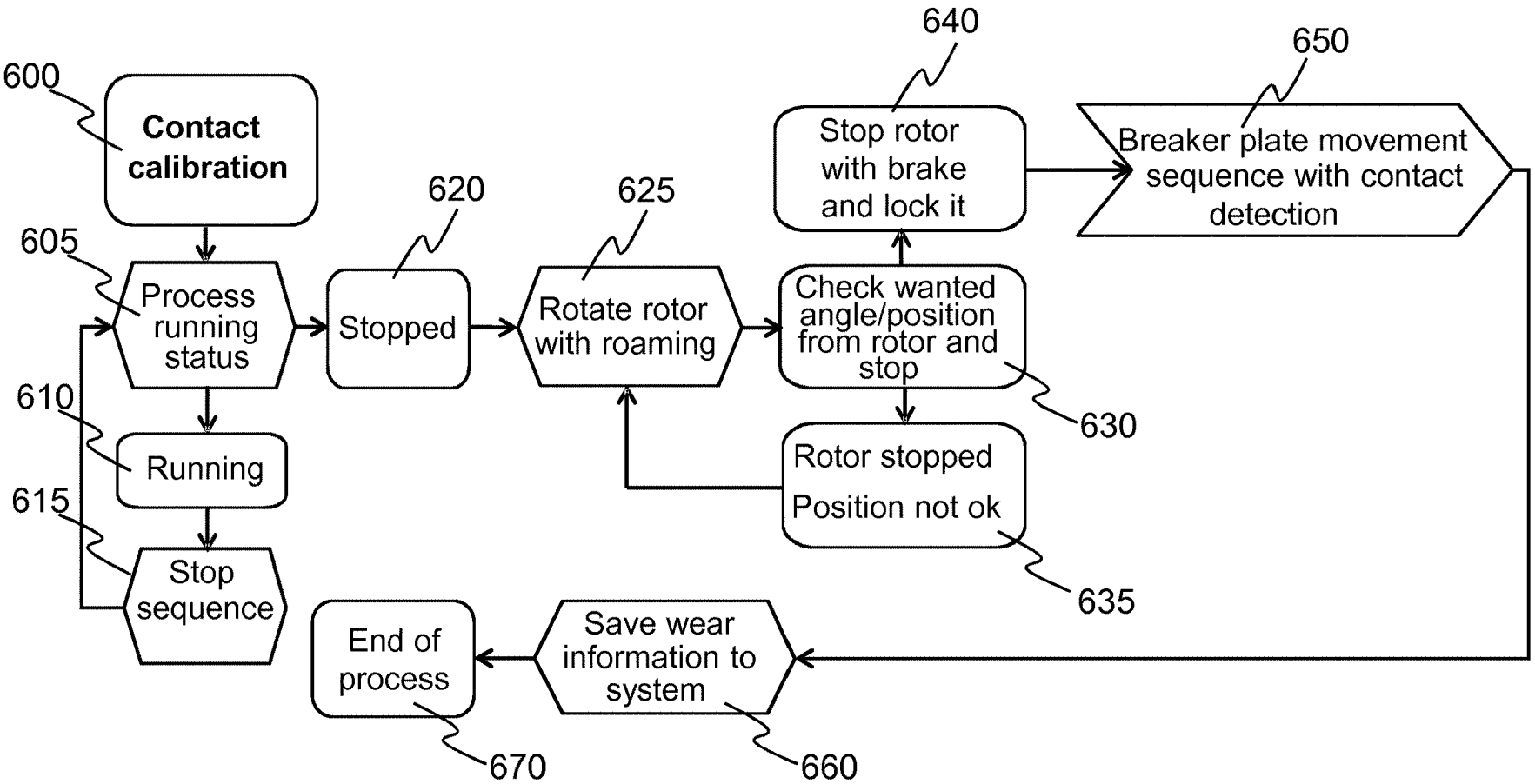
FIG. 6 shows a flow chart of a contact calibration method using the rotor position detection and control according to an example embodiment.

FIG. 6 shows a flow chart of a contact calibration using the rotor position detection and control according to an example embodiment. At step 600 the contact calibration is started.

At step 605 the running status of the process is checked, i.e. the automation and control system 125 checks whether the HSI crusher 200 is running on a full rotor speed or stopped. If it is found out at step 610 that the process is running at production speed, a stop sequence is run and the process is stopped at step 615.

Once it is established at step 620 that the process, and accordingly the rotor 13, is stopped, the rotor 13 is rotated at step 625 at roaming speed using the frequency converter 135 and the brake 140 under control of the motor control system 130 to control the speed of the rotor.

The rotor position detection unit 30 with the sensor 32 measures the position of the rotor 13 during rotating with roaming speed and the rotor is stopped at the desired position. The position is checked at step 630 and if it is established that the position is not correct at step 635, the step 625 of rotating with roaming speed is repeated. If the position is established to be correct at step 630, the rotor is stopped with the brake 140 and locked into place with the locking means.

It should be noted that the process of positioning the hammers 14, 15, 16, 17 at the service position 50 follows an analogous sequence.

At step 650 the contact calibration is finalized by driving the combination of wear part and breaker plate 18, 20 towards the hammer 14, 15, 16, 17 at the contact calibration position 60 until contact is established. The distance at which the contact occurs corresponds to the wear of the wear part 18 and/or to the wear of the hammer 14, 15, 16, 17. The wear information is saved to the automation and control system 125 at step 660 and the contact calibration process is ended at step 670.

Figure 7:
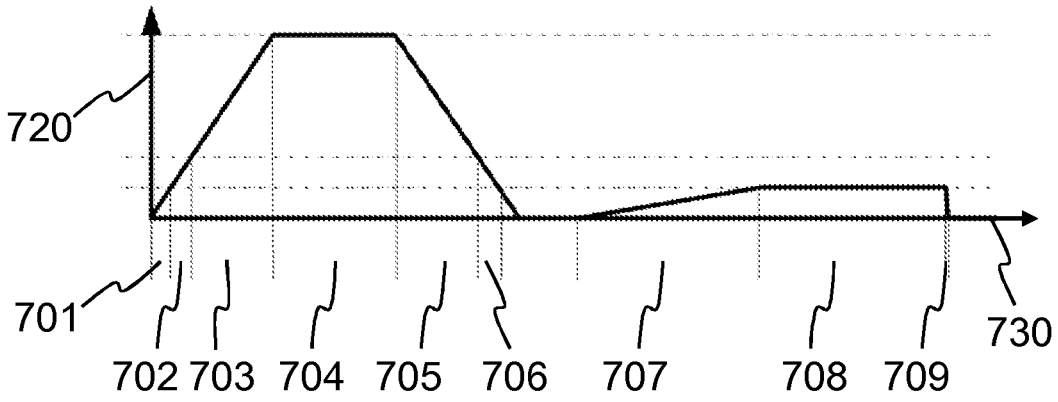
FIG. 7 shows an example operating sequence of a horizontal shaft impactor crusher according to an example embodiment using the rotor position detection and control according to an example embodiment.

FIG. 7 shows an example operating sequence of an HSI crusher according to an example embodiment using the rotor position detection and control according to an example embodiment. The vertical axis 720 of the graph shows the rotation speed of the rotor 13 and the horizontal axis shows time.

During a first period 701 after the rotor is started up, it is possible to carry out rotor positioning to either the contact calibration position 60 or service position 50 according to an example embodiment as hereinbefore described. Second and third periods 702 and 703 are ramp-up periods to normal processing speed and the positioning is not possible during these periods, although the rotor position detection unit 30 is measuring the rotor position and position information. A fourth period 704 is a processing period of the HSI crusher 200 with full process speed and the feed to the HSI crusher being enabled. During this fourth period 704 the position information from the rotor position detection unit 30 can be used to provide load information with respect to rotor position.

A fifth period 705 is a ramp-down period of the HSI crusher 200. As the rotor slows down and a sixth period 706 is reached, rotor positioning to either the contact calibration position 60 or service position 50 can be carried out according to an example embodiment as hereinbefore described.

A seventh period 707 is a roaming ramp-up period, wherein using the frequency converter 135 under control of the motor control system 130, the speed is slowly increased to a predetermined maximum rotor positioning speed at which speed the rotor 13 is rotated during an eighth period 708 to position it to either the contact calibration position 60 or service position 50 according to an example embodiment as hereinbefore described. During a ninth period 709 the rotor 13 is stopped at the desired position, detected with the rotor position detection unit 30, with the brake 140 under control of the motor control system 130.

Without in any way limiting the scope, interpretation, or application of the claims appearing below, a technical effect of one or more of the example embodiments disclosed herein is to provide a simple and reliable way of rotor positioning. Another technical effect of one or more of the example embodiments disclosed herein is to enable the detection of the position and control of the position of each single hammer. Another technical effect of one or more of the example embodiments disclosed herein is to decrease the cost of rotor positioning. A further technical effect of one or more example embodiments is to increase safety of crusher maintenance operations. A still further technical effect of one or more of the example embodiments disclosed herein is the provision of easier contact calibration. A still further technical effect of one or more of the example embodiments is to increase crusher capacity thanks to more precise load monitoring.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

The invention claimed is:

1. An apparatus comprising:

a rotor position detection unit configured to detect an angular position of a rotor of a horizontal shaft impact crusher, the rotor having attached thereon a group of hammers, the rotor position detection unit comprising a sensor;

a motor control system configured to change the rotation speed of the rotor; and an automation and control system configured to control the motor control system in response to the detected angular position of the rotor; wherein the rotor position detection unit is configured to detect a first discrete angular position of the rotor corresponding to a first position of at least a first hammer and a second hammer of the group of hammers attached to the rotor;

the rotor position detection unit is configured to detect a second discrete angular position of the rotor corresponding to a second position of at least the first hammer and the second hammer of the group of hammers attached to the rotor; and the motor control system comprises a frequency converter and a brake that are both together configured to enable the stopping of the rotor in response to detecting the first or second position of the hammer.

2. The apparatus of claim 1, wherein the rotor position detection unit comprises a distance sensor and a counterpart disc.

3. The apparatus of claim 2, wherein the distance sensor is an ultrasound distance sensor and the counterpart disc is a disc with a varying diameter.

4. The apparatus of claim 1, wherein the rotor position detection unit comprises an angular sensor.

5. The apparatus of claim 1, wherein the rotor position detection unit comprises an optical sensor.

6. The apparatus of claim 1, wherein the rotor position detection unit comprises a magnetic sensor.

7. The apparatus of claim 1, wherein the group of hammers comprises four hammers.

8. The apparatus of claim 7, wherein the rotor position detection unit is configured to detect the angular positions of the rotor corresponding to the first position and the second position of the four hammers attached to the rotor.

9. The apparatus of claim 1, wherein the first position of each hammer of the group of hammers is a service position of the hammer.

10. The apparatus of claim 1, wherein the second position of each hammer of the group of hammers is a contact calibration position of the hammer.

11. The apparatus of claim 1, wherein the motor control system is configured to stop the rotor at the first or second position of a hammer of the group of hammers using the frequency converter and the brake in response to detecting the first or second position of the hammer of the group of hammers.

12. The apparatus of claim 1, wherein the sensor is configured to output a standard signal.

13. The apparatus of claim 12, wherein the standard signal has a range of 4 mA to 20 mA.

14. The apparatus claim 1, wherein the automation and control system is further configured to measure the load of the crusher.

15. The apparatus of claim 14, wherein the automation and control system is further configured to combine the measured load and the detected angular position of the rotor in order to monitor the crusher.

* * * * *